US011378251B2

(12) United States Patent
Anctil

(10) Patent No.: US 11,378,251 B2
(45) Date of Patent: Jul. 5, 2022

(54) DOUBLE-CONE CANDLE SHADE

(71) Applicant: Timothy Anctil, Los Angeles, CA (US)

(72) Inventor: Timothy Anctil, Los Angeles, CA (US)

( * ) Notice: Subject to any disclaimer, the term of this patent is extended or adjusted under 35 U.S.C. 154(b) by 0 days.

(21) Appl. No.: 17/555,407

(22) Filed: Dec. 18, 2021

(65) Prior Publication Data

US 2022/0113000 A1 Apr. 14, 2022

(51) Int. Cl.
*F21V 3/02* (2006.01)
*F21V 3/06* (2018.01)

(52) U.S. Cl.
CPC ..... *F21V 3/02* (2013.01); *F21V 3/062* (2018.02)

(58) Field of Classification Search
CPC ..... F21V 1/12; F21V 1/146; F21V 37/0075; F21V 37/0095; F21V 37/00; F21V 35/00; F21V 3/062; F21V 3/02; F21V 3/00
See application file for complete search history.

(56) References Cited

U.S. PATENT DOCUMENTS 1,450,580 A * 4/1923 Courteen ..... F21V 37/0095 431/323
2,050,151 A * 8/1936 Baumer ..... F21V 37/0095 431/291
2,611,685 A 9/1952 Yoder
D353,215 S 12/1994 Koch
10,041,632 B1 * 8/2018 Hsieh ..... F21V 3/02
2003/0016523 A1 1/2003 Pickens

FOREIGN PATENT DOCUMENTS

JP 2002042522 A * 2/2002
KR 2013000684 U * 1/2013

OTHER PUBLICATIONS

Homesick, "How to Fix Candle Tunneling" (May 5, 2020), homesick.com/blogs/news/how-to-fix-candle-tunneling (accessed, saved, and archived Oct. 19, 2021). See paragraph 7: "Light the candle and then place a tent of aluminum foil over the top. Poke a hole in the top so that smoke can escape . . . (the foil will be very hot!)" This is the only known prior art for the purpose of facilitating candle setting / reducing tunneling.

(Continued)

*Primary Examiner* — Anabel Ton
(74) *Attorney, Agent, or Firm* — Scot Fagerland

(57) ABSTRACT

A candle shade is adapted to fit securely atop a candle vessel. The shade assumes the form of a double conical frustum. An interior shell makes direct contact with the candle vessel. The interior shell reflects radiative heat back to the candle surface while allowing smoke and gases to vent upward. Ideally, it is constructed from aluminum sheet metal and includes a band near the lower opening for an airtight seal. An exterior shell encloses the interior shell. The exterior shell protects the outer environment from the heat of the flame, especially so that the shade can be handled safely. Insulation is aided by handles on the exterior shell. Spacers affixed to the interior shell also create an insulating air space between the interior and exterior shells. The double-cone candle shade reduces candle "set" time by 65%.

3 Claims, 4 Drawing Sheets

(56) References Cited

OTHER PUBLICATIONS

Biedermann and Sons, "Biedermann & Sons Decorative Glass Jar Candle Shade, 6×4.5-Inches, Clear", https://www.amazon.com/Biedermann-Sons-Clear-Glass-Candle/dp/B00ADPWB7W (accessed, saved, and archived Oct. 19, 2021). A single-coned, glass candle shade. Not suitably reflective to reduce tunneling. Too hot to handle.
A Cheerful Giver, "A Cheerful Giver Victorian Candle Shade, Copper", https://www.amazon.com/Cheerful-Giver-Victorian-Candle-Copper/dp/B00UFMCO98 (accessed, saved, and archived Oct. 19, 2021). A single-coned copper candle shade with cut pattern. Too perforated to reduce tunneling. Too hot to handle.
Temp-Tations LLC, "Dee-Vine Candle Shade", https://temp-tations.com/products/tara-at-home-dee-vine-candle-shade (accessed, saved, and archived Oct. 19, 2021). A single-coned ceramic candle shade with cut pattern. Perforated and not suitably reflective for tunneling. Too hot to handle.
Brass & Silver Traditions, LLC, "Cassidy Candle Shade, Pewter", https://www.brassandsilvertraditions.com/Cassidy-Candle-Shade-Pewter_p_1473.html (accessed, saved, and archived Oct. 19, 2021). Too perforated to reflect heat and reduce tunneling. Too hot to handle. Note that none of the prior art is constructed from aluminum sheet metal or plastic resin.

* cited by examiner

DOUBLE-CONE CANDLE SHADE

1. FIELD OF THE INVENTION

This invention is in the field of heat and light shades, specifically candle shades.

2. BACKGROUND OF THE INVENTION

A jar candle that is burned for the first time must be "set". That is, it must burn long enough for the wax to liquify across the width of the entire vessel. Otherwise, subsequent burns melt only as far as the first burn, leading to candle "tunneling".

3. DESCRIPTION OF RELATED TECHNOLOGY

A well-known remedy to help a candle set more quickly is to cover it with a "tent", a funnel made of tin foil or aluminum foil. The foil reflects heat back to the candle, while a hole at the top allows smoke and gas to escape.

4. SUMMARY OF THE INVENTION

The present invention, the "Candle Collar", is a double-layered candle tent. It is a durable, reusable product rather than a makeshift aluminum foil creation.

The Candle Collar is a multi-function product marketed to true candle enthusiasts. It is designed to be placed over the top of a candle jar, with three main functions. The primary function is to trap in the heat produced by the candle, allowing an even distribution of heat inside the candle/collar, ensuring that the candle fully liquifies across the entire width of the vessel, eliminating Candle Tunneling, and allowing the candle to "set" in approximately 60% less burn time than without the Candle Collar. As a second benefit, the Candle Collar makes the presence of a burning candle vastly safer when in the presence of pets or children, many of which are curious and risk injury and are often at "candle surface height" such as a table or dresser. Finally, the frequent use of a Candle Collar will reduce overall risk of any open flame burning in an open space. The Candle Collar sits securely and is held steadily with internal silicon bands.

5. BRIEF DESCRIPTION OF THE DRAWINGS

6. DETAILED DESCRIPTION OF THE PREFERRED EMBODIMENTS

Figure 1:
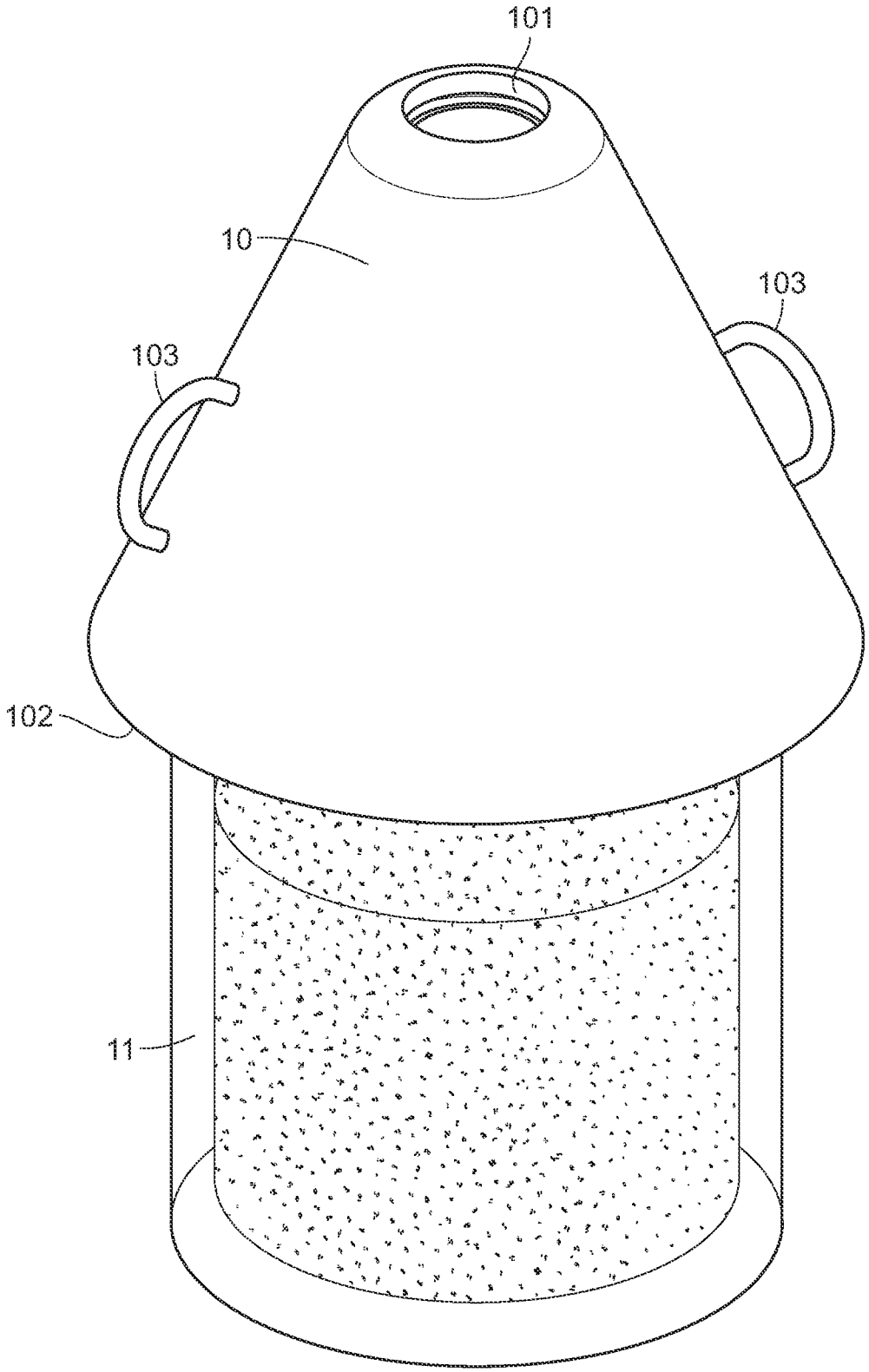
FIG. 1 shows the invention in place atop a candle jar. The exterior shell is visible.

The Candle Collar has two main components: an exterior shell 10 and an interior shell 20. The exterior shell is seen best in FIG. 1, which shows the invention in place atop a candle vessel 11. The exterior shell is an overlay in the shape of a conical frustum. It is ideally made of a non-flammable plastic resin compound. It may alternatively be made of ceramic or glass. The exterior shell has an exterior shell upper opening 101 and an exterior shell lower opening 102. The main purpose of the exterior shell is to shield the environment from the heat of the candle flame. For additional safety, handles 103 may be attached to the exterior shell. The outer shell is decorative and may be personalized to blend in seamlessly with the decor.

Figure 2:
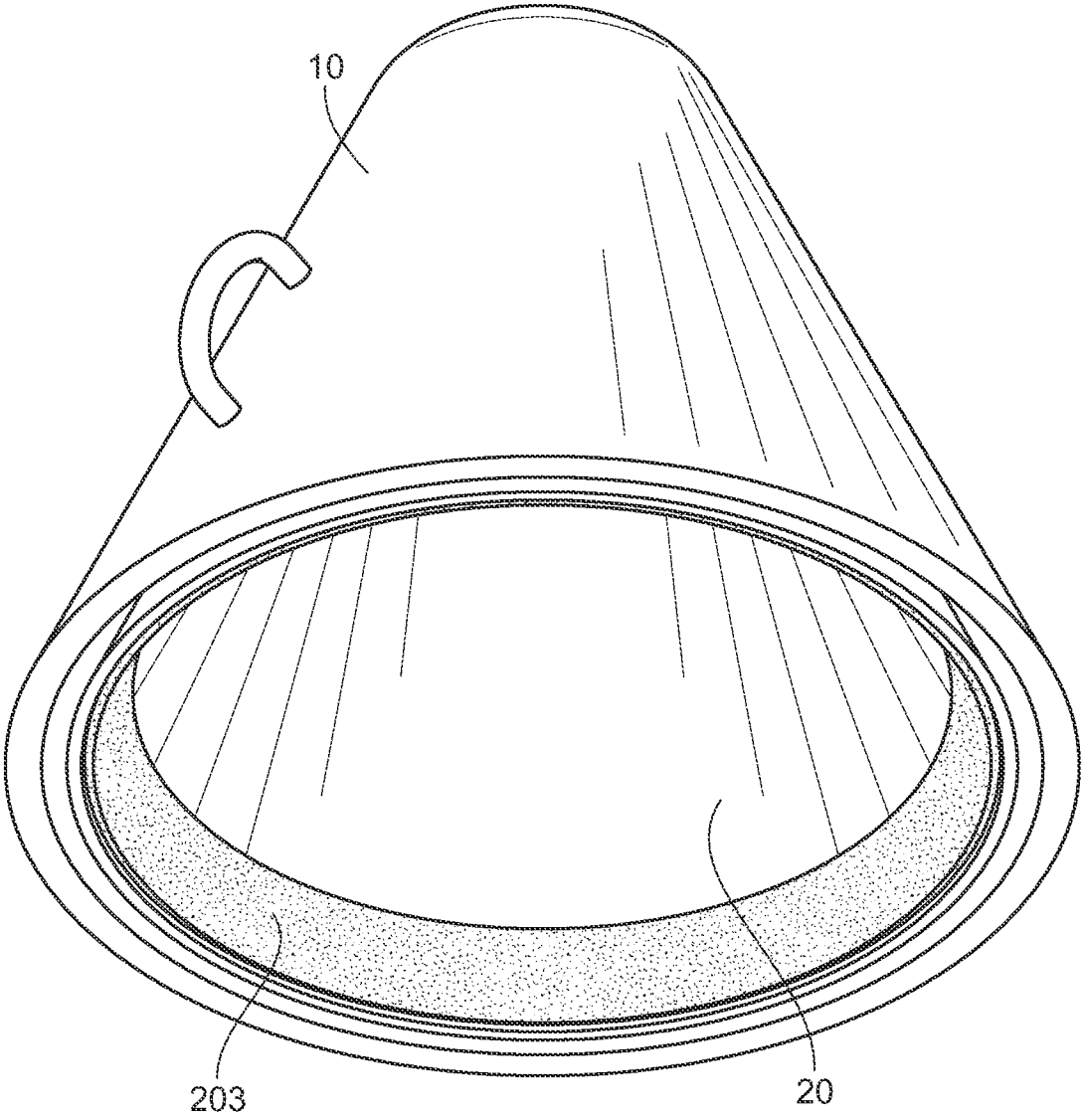
FIG. 2 shows the interior shell.

The interior shell 20 is shown in FIG. 2. It is also shaped as a conical frustum. The interior shell is ideally made of two-ply aluminum sheet metal joined at a seam 205. The seam may be soldered, glued, or riveted. The interior shell has an interior shell upper opening 201 and an interior shell lower opening 202. The main purpose of the interior shell is to reflect the candle flame's heat back to the candle. A secure, air-tight fit is important. This fit is facilitated by a band 203 of non-slip/non-flammable material on the inside lower lip of the interior shell.

It is important to maintain an insulating space 31 between the interior shell and the exterior shell so that the interior shell can reflect heat back to the candle while the exterior shell shields the outer environment from the heat. See FIG. 3. A gap of roughly 2 mm is ideal. This gap is maintained with a plurality of spacers 204 secured to the interior shell.

Figure 3:
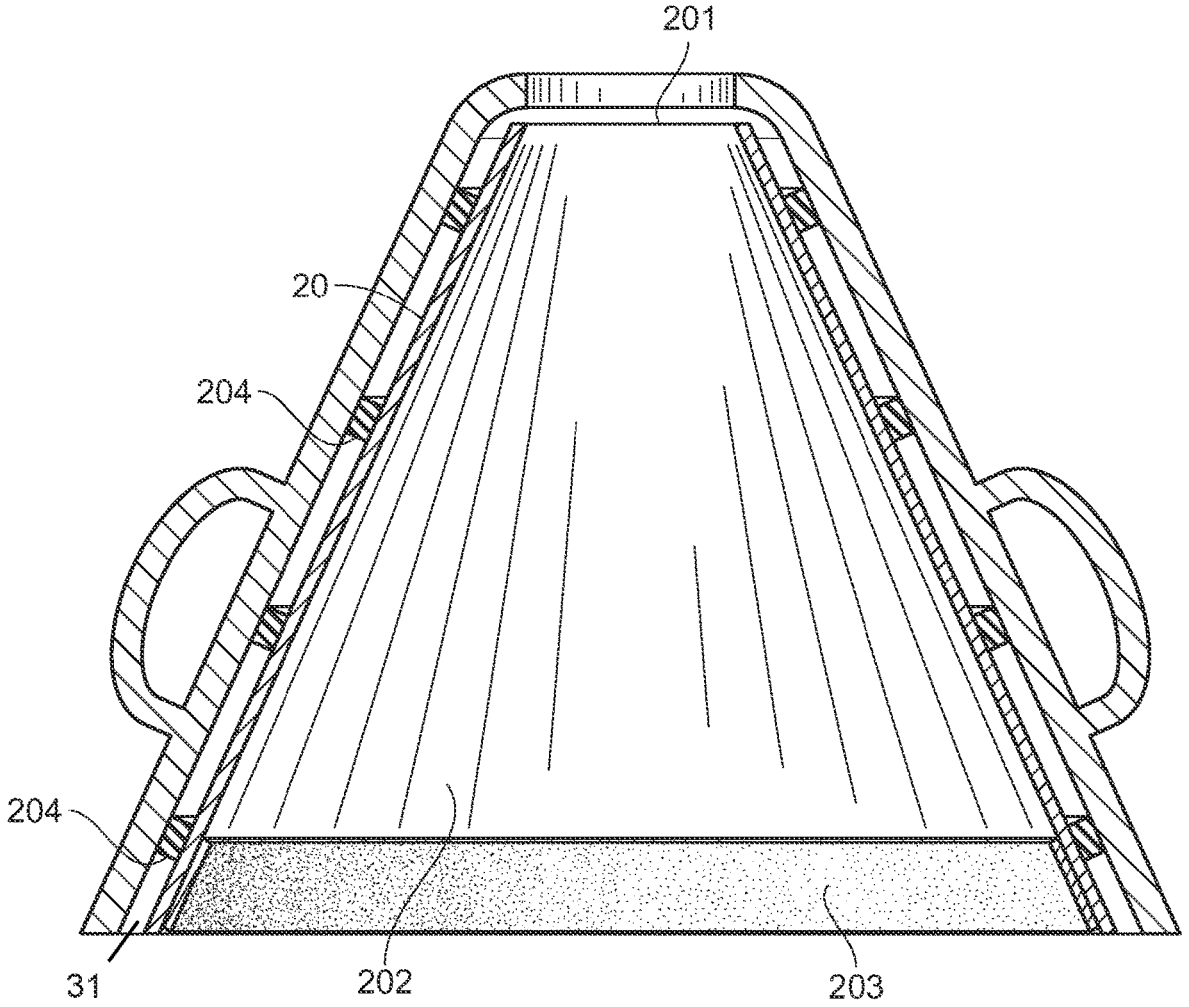
FIG. 3 depicts the interior shell fitted into the exterior shell to create a double-cone structure.
Figure 4:
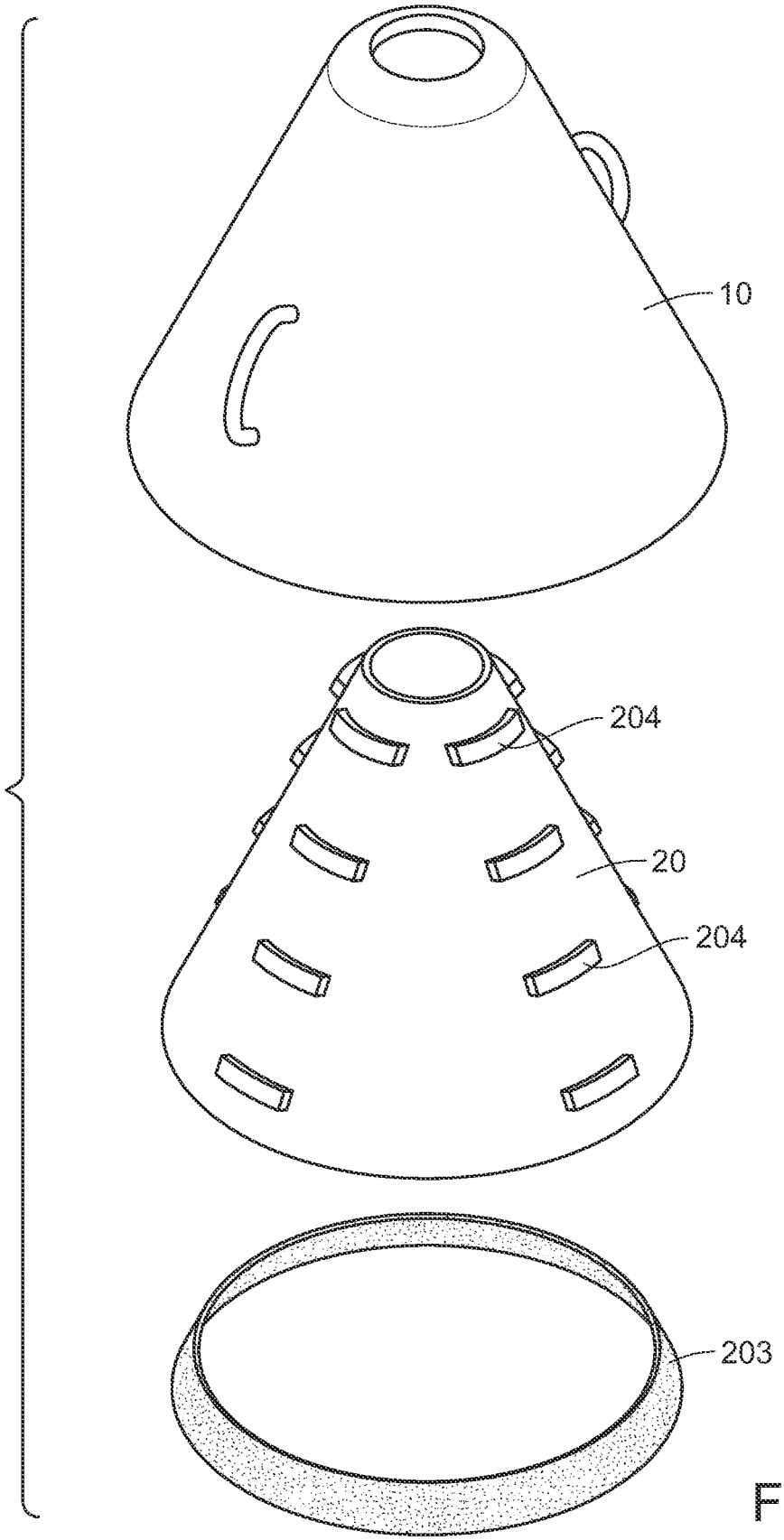
FIG. 4 is an exploded view showing the exterior shell, interior shell, and band.

FIG. 3 illustrates the interior shell 20 in position nested inside the exterior shell 10. As a whole, this device would be inverted and then positioned atop the candle vessel as seen in FIG. 1. Refer to FIG. 4 for an exploded view.

Experimentation has shown that the Candle Collar helps candles set significantly more quickly than tents improvised from aluminum foil or tin foil. Candles covered by the Candle Collar set in roughly ⅓ of the time required for candles covered by aluminum foil funnels.

I claim:

1. A shade for a candle vessel, comprising:
- an exterior shell substantially in the shape of a conical frustum, comprising
  - an exterior shell upper opening
  - and an exterior shell lower opening;
- an interior shell substantially in the shape of a conical frustum similar to and smaller than the exterior shell, seated inside the exterior shell and comprising
  - an interior shell upper opening
  - and an interior shell lower opening;
- a plurality of spacers attached to the interior shell;
- an insulating space between the interior shell and the exterior shell, as a result of the spacers;
- and handles affixed to the exterior shell.

2. The shade of claim 1,
- further comprising a band of non-slip, non-flammable material affixed to the interior shell in proximity to the interior shell lower opening;
- and wherein
  - the interior shell is constructed from two-ply aluminum sheet metal;
  - the exterior shell is constructed from a plastic resin compound;
  - and the insulating space has a width between 1.5 mm and 2.5 mm.

3. The shade of claim 1,
- further comprising a band of non-slip, non-flammable material affixed to the interior shell in proximity to the interior shell lower opening;
- and wherein
  - the interior shell is constructed from two-ply aluminum sheet metal;
  - the exterior shell is constructed from a material selected from the group consisting of glass and ceramic;

and the insulating space has a width between 1.5 mm and 2.5 mm.

* * * * *